United States Patent [19]

Yoshino et al.

[11] 4,139,832

[45] Feb. 13, 1979

[54] GLASS-COATED THICK FILM RESISTOR

[75] Inventors: Yoshimi Yoshino, Yokohama; Nobuyuki Sugishita, Yokosuka, both of Japan

[73] Assignee: Hitachi, Ltd., Japan

[21] Appl. No.: 773,175

[22] Filed: Mar. 1, 1977

[30] Foreign Application Priority Data

Mar. 19, 1976 [JP] Japan ..... 51-29245
Apr. 7, 1976 [JP] Japan ..... 51-38274

[51] Int. Cl.[2] ..... H01C 1/012

[52] U.S. Cl. ..... 338/308; 338/309; 338/314

[58] Field of Search ..... 338/308, 307, 309, 314; 29/613, 610, 620; 357/73; 252/514, 518; 427/103, 125, 126; 106/53

[56] References Cited

U.S. PATENT DOCUMENTS

| | | | |
|---|---|---|---|
| 3,337,365 | 8/1967 | Mones | 338/308 X |
| 3,374,110 | 3/1968 | Miller | 252/514 X |
| 3,434,877 | 3/1969 | Degenkolb et al. | 338/309 X |
| 3,849,757 | 11/1974 | Khammous et al. | 338/309 X |
| 3,914,514 | 10/1975 | Mackenzie et al. | 252/514 X |
| 3,916,037 | 10/1975 | Brady et al. | 252/518 X |

*Primary Examiner*—C. L. Albritton
*Attorney, Agent, or Firm*—Craig & Antonelli

[57] ABSTRACT

A glass-coated thick film resistor can be obtained by coating completely with a crystallizable glass having a crystallizing temperature of 400 to 600° C and consisting of 62 to 80% by weight of PbO, 5 to 31% by weight of ZnO, 5 to 18% by weight of $B_2O_3$, 0.2 to 8% by weight of $Al_2O_3$ and 1 to 5% by weight of $SiO_2$.

5 Claims, 4 Drawing Figures

GLASS-COATED THICK FILM RESISTOR

BACKGROUND OF THE INVENTION

1. Field of the Invention

The present invention relates to a glass-coated thick film resistor coated by a crystallizable glass having a firing temperature of 400° to 600° C. and consisting of PbO, ZnO, $B_2O_3$, $Al_2O_3$ and $SiO_2$.

2. Description of the Prior Art

In general, a glass-coated thick film resistor has heretofore been obtained by printing a conductive paste onto an alumina substrate, firing the coating to form at least two terminals, printing a resistor paste consisting of conductive powder such as Ag-Pd or $RuO_2$, glass frit and an organic vehicle onto said substrate and said terminals, firing the coating to form a thick film resistor, printing a glass paste to cover the resistor completely, and then firing the coating to form a glass-coated thick film resistor.

As for the characteristic required for the glass used in the formation of said glass coating, it is necessary for the glass to have a firing temperature of 400° to 600° C. If the firing temperature is lower than 400° C., Ag in Ag-Pd which is a component of the conductor is undesirably oxidized, resulting in an increase in the resistance of a conductor part and the deterioration of solderability. Also, if the firing temperature is higher than 600° C., the resistance of the resistor undesirably increases. When the firing temperature is 400° C. or more, oxide of Ag in Ag-Pd which is a component of the conductor is decomposed.

Amorphous glasses such as lead borosilicate glass have heretofore been used in the glass coating. However, the low melting amorphous glasses have a defect in that their water resistance is poor. In order to obviate this defect, a crystallized glass consisting of PbO, ZnO and $B_2O_3$ was examined, but it was found that the glass had a defect in that its water resistance was poor.

SUMMARY OF THE INVENTION

An object of the present invention is to provide a glass-coated thick film resistor having excellent water resistance.

Another object of the invention is to provide a glass-coated thick film resistor having excellent crack resistance.

As a result of various studies on crystallizable glasses, the present inventors have now found that crystallizable glasses obtained by adding $Al_2O_3$ and $SiO_2$ to a crystallizable glass consisting of PbO, ZnO and $B_2O_3$ is suitable for accomplishing the abovementioned objects. If only $Al_2O_3$ is added to the crystallizable glass consisting of PbO, ZnO and $B_2O_3$, the resulting mixture is almost unpractical since it is difficult to melt the low melting materials although its water resistance is improved. Also, if only $SiO_2$ is added to the crystallizable glass consisting of PbO, ZnO and $B_2O_3$, the resulting mixture is not preferable since its water resistance can not be improved although it becomes easier to melt. Thus, it has now been found that a glass suitable for obtaining glass-coated thick film resistors which is easy to melt the low melting materials and is excellent in water resistance and crack resistance can be obtained only by adding $Al_2O_3$ and $SiO_2$ to the crystallizable glass consisting of PbO, ZnO and $B_2O_3$. Of course, the glasses consisting of PbO, ZnO, $B_2O_3$, $Al_2O_3$ and $SiO_2$ have a crystallizing temperature of 400° to 600° C.

According to the present invention, there is provided a glass-coated thick film resistor consisting of a substrate, at least two terminals formed on said substrate, a resistor formed on said substrate and on said terminals so that said at least two terminals may be connected to each other, and a glass coating layer formed by covering said resistor to isolate at least the outer surface of the resistor from the external atmosphere, wherein said glass coating layer consists of a crystallizable glass consisting of 62 to 80% by weight of PbO, 5 to 31% by weight of ZnO, 5 to 18% by weight of $B_2O_3$, 0.2 to 8% by weight of $Al_2O_3$ and 1 to 5% by weight of $SiO_2$ and having a crystallizing temperature of 400° to 600° C. The glass-coated thick film resistor shows improved water resistance and good crack resistance.

The reasons for the above-mentioned restriction of the composition of the glass used will be explained below. As for the restriction of the PbO content to 62 to 80% by weight, the firing temperature of the glass exceeds 600° C. and a change in the resistance of the resistor becomes large if the PbO content is less than 62% by weight. Also, if the PbO content is more than 80% by weight, the firing temperature of the glass becomes lower than 400° C. and the glass does not crystallize and becomes poor in water resistance. As for the restriction of the ZnO to 5 to 31% by weight, the glass does not crystallize and becomes poor in water resistance if the ZnO content is lower than 5% by weight. Also, if the ZnO content is more than 31% by weight, it becomes difficult to form a glass. As for the restriction of the $B_2O_3$ content to 5 to 18% by weight, a homogeneous glass can not be formed and the coating can not be wetted enough if the $B_2O_3$ content is less than 5% by weight. Also, if the $B_2O_3$ content is more than 18% by weight, the glass does not crystallize and becomes poor in water resistance. As for the restriction of the $Al_2O_3$ content to 0.2 to 8% by weight, the glass becomes poor in water resistance if the $Al_2O_3$ content is less than 0.2% by weight. Also, if the $Al_2O_3$ content is more than 8% by weight, it becomes difficult to form a glass. As for the restriction of the $SiO_2$ content to 1 to 5% by weight, the glass becomes poor in water resistance if the $SiO_2$ content is less than 1% by weight. Also, if the $SiO_2$ content is more than 5% by weight, the glass does not crystallize and becomes poor in water resistance.

DETAILED DESCRIPTION OF PREFERRED EMBODIMENTS

The following examples illustrate the present invention.

EXAMPLE 1

A mixture of PbO, ZnO, $B_2O_3$, $Al_2O_3$ and $SiO_2$ as shown by A in Table 1 was charged into a muller mixer and mixed for 2 hours, and was then molten in an electric furnace at 1300° C. for 2 hours. The melt was poured on an iron plate and quenched to obtain a glass. The glass was then pulverized by a ball mill to obtain a frit having a particle size of less than 3μ. 300 Grams of the frit was dispersed in 100 g of an organic vehicle obtained by dissolving ethyl cellulose in α-terpineol to form a glass paste.

Table 1

| Symbol | Composition (% by weight) | | | | |
|---|---|---|---|---|---|
| | PbO | ZnO | $B_2O_3$ | $Al_2O_3$ | $SiO_2$ |
| A | 65 | 15 | 10 | 5 | 5 |
| B | 68 | 20 | 5 | 5 | 2 |
| C | 75 | 14 | 8 | 2 | 1 |
| D | 78 | 11 | 5 | 3 | 3 |
| E | 80 | 5 | 6 | 8 | 1 |
| F | 62 | 18 | 12 | 3 | 5 |
| G | 75 | 5 | 15 | 3 | 2 |
| H | 46 | 31 | 18 | 0.2 | 4.5 |

A glass-coated thick film resistor was obtained with the thus prepared glass paste in the manner as described below.

Figure 1:
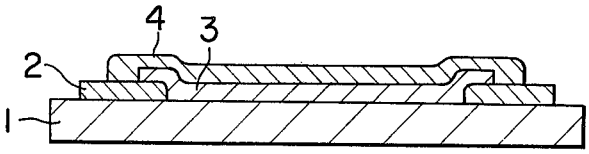
FIG. 1 is a sectional view of a glass-coated thick film resistor.

As shown in FIG. 1, an Ag-Pd conductor paste (9061 manufactured by DuPont Co.) was printed on an alumina substrate (1) and fired at 850° C. for 10 minutes to form terminals (2). A $RuO_2$ resistor paste (1331 manufactured by DuPont Co.) was then printed on said alumina substrate (1) and on said terminals (2) and fired at 850° C. for 10 minutes to form a resistor (3). The glass paste mentioned above was printed on the resistor (3) and fired at 600° C. for 10 minutes to form a glass coating (4) covering the resistor (3) completely.

Figure 2:
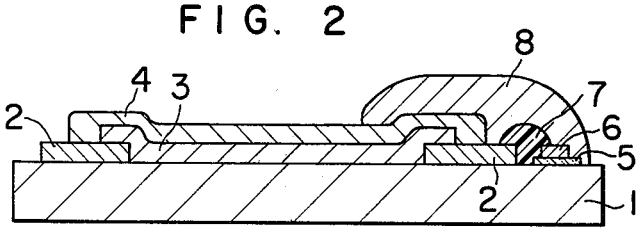
FIG. 2 is a sectional view of the glass-coated thick film resistor equipped with a resin-coated semiconductor element.

On the alumina substrate (1) of the thus prepared glass-coated thick film resistor was installed a gold pad (5), on which a semiconductor element (6) was then installed. The semiconductor element (6) was connected to the terminal (2) by a gold wire (7). The gold pad (5), the semiconductor element (6), the gold wire (7) and the terminal (2) were coated completely by a phenol resin (PR 50702 manufactured by Sumitomo Durez Co. Ltd.) to form a resin film (8). Thus, a glass-coated thick film resistor equipped with a resin-coated semiconductor element as shown in FIG. 2 was obtained.

Thermal shock test at 0° and 100° C. and temperature cycling test at −55° C. for 30 minutes, 25° C. for 15 minutes, and 150° C. for 30 minutes were respectively carried out 1000 times for the thus obtained glass-coated thick film resistor equipped with a resin-coated semiconductor element. It was found that no crack occurred in the glass coating (4).

Figure 3:
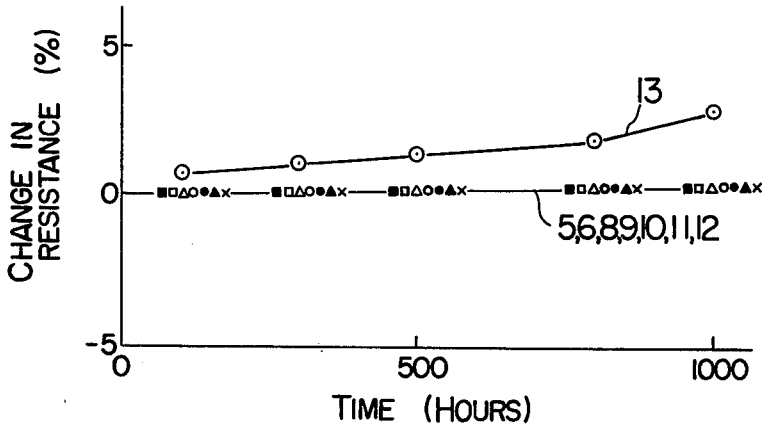
FIG. 3 shows the change in resistance of the glass-coated thick film resistors equipped with resin-coated semiconductor elements wherein the resistor material used is $Ru_2O$ in a load test at a high temperature.

Also, when a load test at 30 $mW/mm^2$ was carried out at a high temperature of 70° C. and a high humidity of 95% RH, substantially no change in resistance occurred even after the lapse of 1000 hours as shown by curve (5) in FIG. 3.

EXAMPLE 2

Glass-coated thick film resistors equipped with a resin-coated semiconductor element as shown in FIG. 2 were prepared in the same manner as in Example 1 using glass frits as shown by B, D, E, F, G and H in Table 1. These frits had the softening temperatures and the crystallizing temperatures as shown in Table 2, and were fired under the conditions as shown in Table 2, respectively. When similar tests as those in Example 1 were carried out for the thus obtained thick film resistors, the results as shown in the "Defect occurrence %" column in the rows B, D, E, F, G and H of Table 2 and as shown by curves (8), (9), (10) and (11) in FIG. 3 were obtained. Thus, the water resistance and crack resistance of the thick film resistors were excellent.

Table 2

| Symbol | Resistor | Coating glass | | | Defect occurrence % | |
|---|---|---|---|---|---|---|
| | | Softening temperature (° C) | Crystallizing temperature (° C) | Firing condition | Temperature cycling test | Thermal shock test |
| A | $RuO_2$ | 556 | 590 | 600° C, 10 min. | 0 | 0 |
| B | | 535 | 578 | 590° C, 10 min. | 0 | 0 |
| C | Ag-Pd | 502 | 532 | 550° C, 10 min. | 0 | 0 |
| D | | 490 | 511 | 530° C, 10 min. | 0 | 0 |
| E | | 450 | 494 | 530° C, 10 min. | 0 | 0 |
| F | $RuO_2$ | 552 | 580 | 600° C, 10 min. | 0 | 0 |
| G | | 379 | 520 | 530° C, 10 min. | 0 | 0 |
| H | | 510 | 540 | 550° C, 10 min. | 0 | 0 |

EXAMPLE 3

Figure 4:
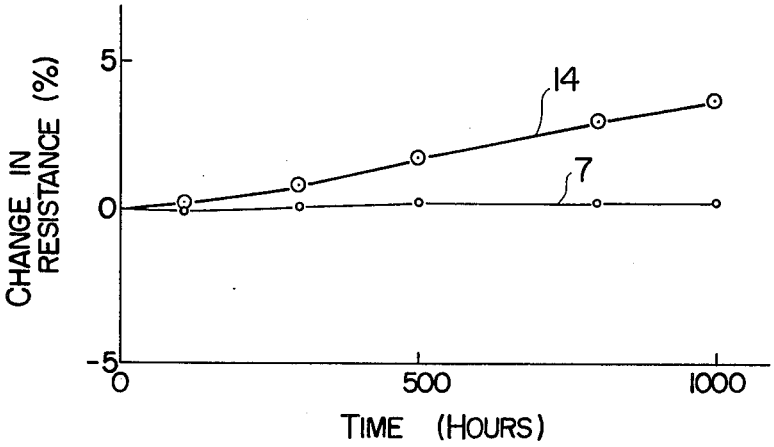
FIG. 4 shows the change in resistance of glass-coated thick film resistors equipped with resin-coated semiconductor elements wherein the resistor material used is Ag-Pd in a load test at a high temperature.

A glass-coated thick film resistor equipped with a resin-coated semiconductor element as shown in FIG. 2 was prepared in the same manner as in Example 1 using an Ag-Pd resistor paste (7013 manufactured by ESL) and a glass frit as shown by C in Table 1 and having the softening temperature, the crystallizing temperature and the firing condition as shown in Table 2. When similar tests as those in Example 1 were carried out for the thus obtained thick film resistor, the results as shown in the "Defect occurrence %" column in the row C of Table 2 and by curve (7) in FIG. 4 were obtained. Thus, the water resistance and crack resistance of the thick film resistor were excellent.

Comparative Example 1

As shown in FIG. 1, terminals (2) and a resistor (3) were formed on an alumina substrate (1) in the same manner as in Example 1. A glass coating (4) was then formed with a glass paste (8185 manufactured by Du-Pont Co.) using the amorphous glass as shown in the row A of Table 3 to obtain a glass-coated thick film resistor. The same subsequent procedure as in Example 1 gave a glass-coated thick film resistor equipped with a resin-coated semiconductor element as shown in FIG. 2. When thermal shock test and temperature cycling test were carried out 1000 times, respectively, for the thus obtained glass-coated thick film resistor equipped with a resin-coated semiconductor element in the same manner as in Example 1, the defect occurrence % was found to be 45% and 100% as shown in the "Defect occurrence %" column in Table 3. Also, in the same load test at a high temperature as in Example 1, the resistance of the thick film resistor increased by 3% after the lapse of 1000 hours as shown by curve (13) in FIG. 3.

Table 3

| | | Coating glass | | | | Defect occurrence % | |
|---|---|---|---|---|---|---|---|
| Symbol | Resistor | Softening temperature (° C) | Crystallizing temperature (° C) | Firing temperature (° C) | Kind of glass | Thermal shock test | Temperature cycling test |
| A | $RuO_2$ | 470 | — | 530 | Amorphous glass | 45 | 100 |
| B | Ag-Pd | 470 | — | 530 | Amorphous glass | 42 | 100 |

Comparative Example 2

A glass-coated thick film resistor equipped with a resin-coated semiconductor element as shown in FIG. 2 was prepared in the same manner as in Comparative Example 1 except that an Ag-Pd resistor paste was used as the resistor. When the same tests as those in Example 1 were carried out for the thus obtained thick film resistor, the defect occurrence % was found to be 42% and 100%, respectively, as shown in the "Defect occurrence %" column in the row B of Table 3. Also, when the same load test at a high temperature as that in Example 1 was carried out, the resistance of the thick film resistor increased by 4% after the lapse of 1000 hours as shown by curve (14) in FIG. 4.

What is claimed is:

1. A glass-coated thick film resistor comprising a substrate, at least two terminals formed on said substrate, a resistor formed on said substrate and between said at least two terminals, and a crystallized glass coating-layer formed on said substrate by covering said resistor, wherein said crystallized glass-coating layer is formed by firing a crystallizable glass-coating consisting of 62 to 80% by weight of PbO, 5 to 31% by weight of ZnO, 5 to 18% by weight of $B_2O_3$, 0.2 to 8% by weight of $Al_2O_3$ and 1 to 5% by weight of $SiO_2$ and having a crystallizing temperature of 400° to 600° C.

2. A glass-coated thick film resistor according to claim 1, further comprising:

a conductive pad formed on said substrate adjacent one of said terminals;

a semiconductor element formed on said conductive pad;

a conductive element coupled between said semiconductor element and said adjacent one of said terminals; and a resin film covering said conductive pad, said semiconductor element, said conductive element and said adjacent one of said terminals.

3. A glass-coated thick film resistor according to claim 1, wherein said substrate comprises alumina.

4. A glass-coated thick film resistor according to claim 3, wherein said resistor is selected from a group consisting of $RuO_2$ and Ag-Pd.

5. A glass-coated thick film resistor according to claim 3, wherein said terminals comprise Ag-Pd.

* * * * *